US007882667B2

(12) United States Patent
Smith

(10) Patent No.: US 7,882,667 B2
(45) Date of Patent: Feb. 8, 2011

(54) STRUCTURAL MEMBER AND POST WITH EXTENDING WINGS

(76) Inventor: Noel G. Smith, 1225 Truax Blvd., Eau Claire, WI (US) 54703

( * ) Notice: Subject to any disclaimer, the term of this patent is extended or adjusted under 35 U.S.C. 154(b) by 56 days.

(21) Appl. No.: 11/938,886

(22) Filed: Nov. 13, 2007

(65) Prior Publication Data

US 2008/0087388 A1 Apr. 17, 2008

Related U.S. Application Data

(62) Division of application No. 10/735,058, filed on Dec. 11, 2003, now Pat. No. 7,316,749.

(51) Int. Cl.
*E04B 2/72* (2006.01)

(52) U.S. Cl. ..... 52/282.3; 52/282.1; 52/588.1; 52/589.1; 52/592.1

(58) Field of Classification Search ..... 52/588.1, 52/589.1, 592.1, 282.3, 282.1
See application file for complete search history.

(56) References Cited

U.S. PATENT DOCUMENTS 2,019,379 A * 10/1935 Anderson ..... 52/588.1
2,648,409 A * 8/1953 Daugherty et al. ..... 52/282.3
3,486,281 A * 12/1969 Gregoire ..... 52/282.3
3,675,379 A * 7/1972 Lambert et al. ..... 52/264
4,700,809 A * 10/1987 Lazar ..... 187/401
5,842,545 A * 12/1998 Blaiotta ..... 52/588.1
6,082,501 A * 7/2000 Lehmann ..... 52/591.1

* cited by examiner

*Primary Examiner*—Richard E Chilcot, Jr.
*Assistant Examiner*—Matthew J Smith
(74) *Attorney, Agent, or Firm*—Anthony J. Bourget; Michael T. Hess

(57) ABSTRACT

A panel for connection with other panels, comprising a rectilinear base member having outer edges, a first rectilinear side member extending from one edge of the base member, the first side member having a first lip extending from an outward edge of the first side member and away from the base member, the first side member further having a second lip extending from an outward edge of the first lip and toward the base member and at an angle between about zero and 90 degrees with respect to the first lip, and a second rectilinear side member extending in substantially the same direction as the first side member, from an opposite edge of the base member, the second side member having a third lip extending toward the base member. Related structural members, enclosures, posts, spray booths and methods for assembling the same which include similar features are provided.

10 Claims, 18 Drawing Sheets

21

20

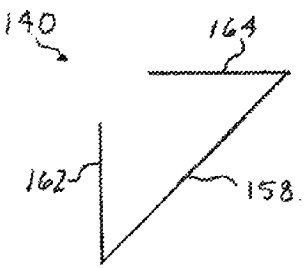
FIG. 24
FIG. 22
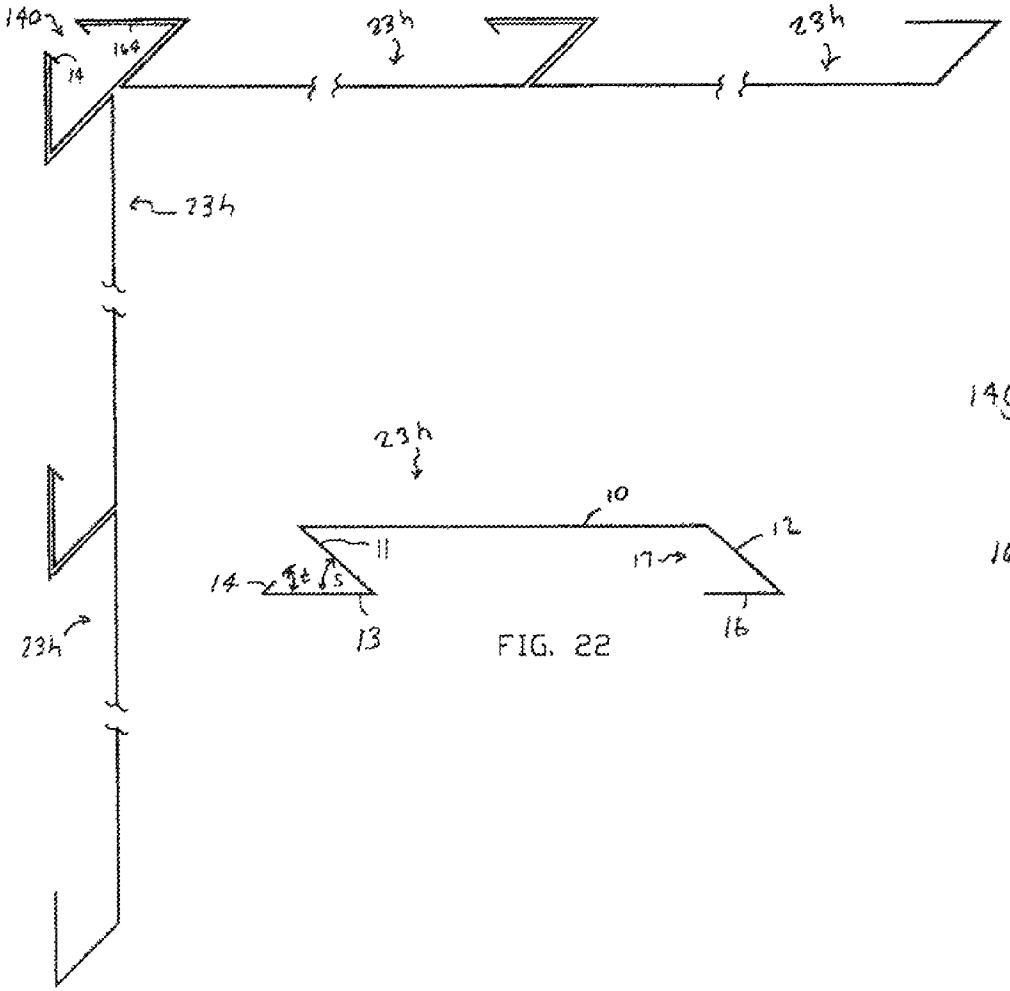
FIG. 23

STRUCTURAL MEMBER AND POST WITH EXTENDING WINGS

CROSS REFERENCE TO RELATED APPLICATIONS

This application is a divisional application of U.S. patent application Ser. No. 10/735,058, filed Dec. 11, 2003, now U.S. Pat. No. 7,316,749, and incorporated herein in its entirety.

BACKGROUND OF THE INVENTION

1. Field of the Invention

This invention relates to panels for enclosures and methods for assembling enclosures, and more particularly to a metal spray booth assembly and method for assembling the same.

2. Background Information

Enclosures, or wall systems are useful for a variety of purposes, including housing of items, animals, displays, or other items requiring to be bounded by a structure. Metal enclosures are particularly useful for a spray booth configuration in which a user may, for instance, spray paint or powder coat various articles within the space bounded by the spray booth enclosure which is generally fitted with ventilation units and other items to accommodate removal of hazardous fumes and particulate.

Spray booths are typically assembled from a variety of component parts. The parts are manufactured in one location and then assembled at another location where the booth is intended to be used. Booths usually include several formed and punched panels which are packaged together with assembly hardware to be field erected at the customer's site. The panels are typically connected together in a box-like fashion as is known in the art. Assembly of the booth generally requires use of hardware or fasteners such as rivets, bolts, screws, and the like to hold the panels together; and sometimes booth components will be welded. The panels are formed and punched so as to bolt together to achieve structural integrity. The booth must be structurally sound so as to be free-standing and possibly able to support accessory equipment. The metal enclosures must also withstand demands of the manufacturing environment.

Assembling the spray booth often requires experience and precision, especially in the alignment of booth components and in the use of fastening tools. Assembly must also be made with an understanding of the structural requirements for the use of the booth. Booths can come in a variety of sizes ranging from small table-top spraying units to very large commercial structures useful for purposes of painting automobiles or other large products. In some cases the booths remain stationary for a long period of time. In others, it is desired to move the booths to accommodate flexibility in the manufacturing process.

Typically a spray booth includes a box-like structure having a front opening for insertion of the article to be treated. A typical booth might also include screens or curtains to prevent dissipation of spray materials including odors. A typical ten foot wide×eight foot high ×eight foot deep enclosure having a filter wall and exhaust plenum would require 405 nuts and bolts for the enclosure, 110 nuts and bolts for the filter rack, and 24 nuts and bolts for two lights, amounting to a total of 539 nuts and bolts. Also, to insure a dust/vapor seal to be present at the seams, the panels also require a bead of caulking to be applied to abutting surfaces before assembling and bolting. Lights, as required, are bolted in place requiring one person to be positioned inside the enclosure and a person positioned outside the enclosure. Typical booth erection time for two assemblers working together, not including unpacking, floor fastening, and electrical and venting installation, can run approximately five hours per assembler.

A significant drawback in the manufacture or assembly of spray booths is in the time and effort it takes to create and then assemble a workable unit. Moreover, uniformity of assembled units is often desired so as to efficiently produce a quality product. Precision drilling or bolt fastening is often required which takes time and talent and generally the result requires higher labor cost and longer delivery or turnaround times. Multiple assemblers are often required. Working with a variety of awkward parts to be assembled poses a risk for injury in the use or assembling of spray booth parts. Requiring caulking as a step further increases the difficulty, expense, and possible failure of the assembly. Having a complicated booth structure also increases the risk of improper assembly and the potential for structural failure and short product lifecycle. Moreover, a complicated product tends to result in lower uniformity from one assembled enclosure to another.

Accordingly, it would be desirable to develop a booth structure having component parts which are easy to manufacture, and which is capable of being quickly and easily assembled without the use of complicating fasteners and/or extensive caulking. It would further be ideal to provide a booth with component parts that are pre-fabricated to engage with each other so as to create a stable self-supporting structure. In addition, providing a structure than can be assembled with little or no training would have substantial benefit in the marketplace and result in uniformity of structures with greater certainty of stability. Ease of assembly and disassembly also leads to overall manufacturing efficiency given the flexibility for modification of the size of the booth and/or transportation of the booth. Also, reduction of parts would lessen the likelihood of having missing parts or requirement to find replacement parts.

SUMMARY OF THE INVENTION

The present invention has been made in view of the foregoing disadvantages of the prior art. Accordingly, one aspect of the present invention is to overcome these disadvantages, and further to provide a booth structure which is capable of being assembled without the use of external fastening devices.

It is another aspect of the present invention to provide a spray booth structure which is capable of fast assembly and disassembly.

It is yet another aspect of the present invention to provide a method of assembling a booth structure for use in a variety of areas including use as a spray booth.

It is still a further aspect of the present invention to provide a booth structure which is capable of accomplishing the above-described aspects with a simple structure.

Further aspect of the invention are provided as referenced throughout the specification.

In accordance with the present invention, a panel for connection with other panels is provided. The panel comprises a rectilinear base member having outer edges, a first rectilinear side member extending from one edge of the base member, the first side member having a first lip extending from an outward edge of the first side member and away from the base member, the first side member further having a second lip extending from an outward edge of the first lip and toward the base member and at an angle between about zero and 90 degrees with respect to the first lip, and a second rectilinear side member extending in substantially the same direction as the first side member, from an opposite edge of the base member, the second side member having a third lip extending toward the base member.

In accordance with a further aspect of the present invention, a structural member such as a wall or ceiling is provided. The structural member comprises a first panel, including a rectilinear base member having outer edges, a first rectilinear side member extending from one edge of the base member, the first side member having a first lip extending from an outward edge of the first side member and away from the base member, the first side member further having a second lip extending from an outward edge of the first lip and toward the base member and at an angle between about zero and 90 degrees with respect to the first lip, and a second rectilinear side member extending in substantially the same direction as the first side member, from an opposite edge of the base member, the second side member having a third lip extending toward the base member, and at least one second panel communicatively connected to the first panel, the at least one second panel including a rectilinear base member having outer edges, a first rectilinear side member extending from one edge of the base member, the first side member having a first lip extending from an outward edge of the first side member and away from the base member, the first side member further having a second lip extending from an outward edge of the first lip and toward the base member and at an angle between about zero and 90 degrees with respect to the first lip, and a second rectilinear side member extending in substantially the same direction as the first side member, from an opposite edge of the base member, the second side member having a third lip extending toward the base member.

Further aspects of the invention include related structural members, enclosures, panels, spray booths and methods for assembling the same as described herein.

BRIEF DESCRIPTION OF THE DRAWINGS

FIG. 22 is a top view of a further embodiment of the panel of the present invention.

FIG. 23 is a top view of a further structural member of the present invention.

FIG. 24 is a top view of a further embodiment of the post of the present invention.

DESCRIPTION OF THE EMBODIMENTS

Figure 1:
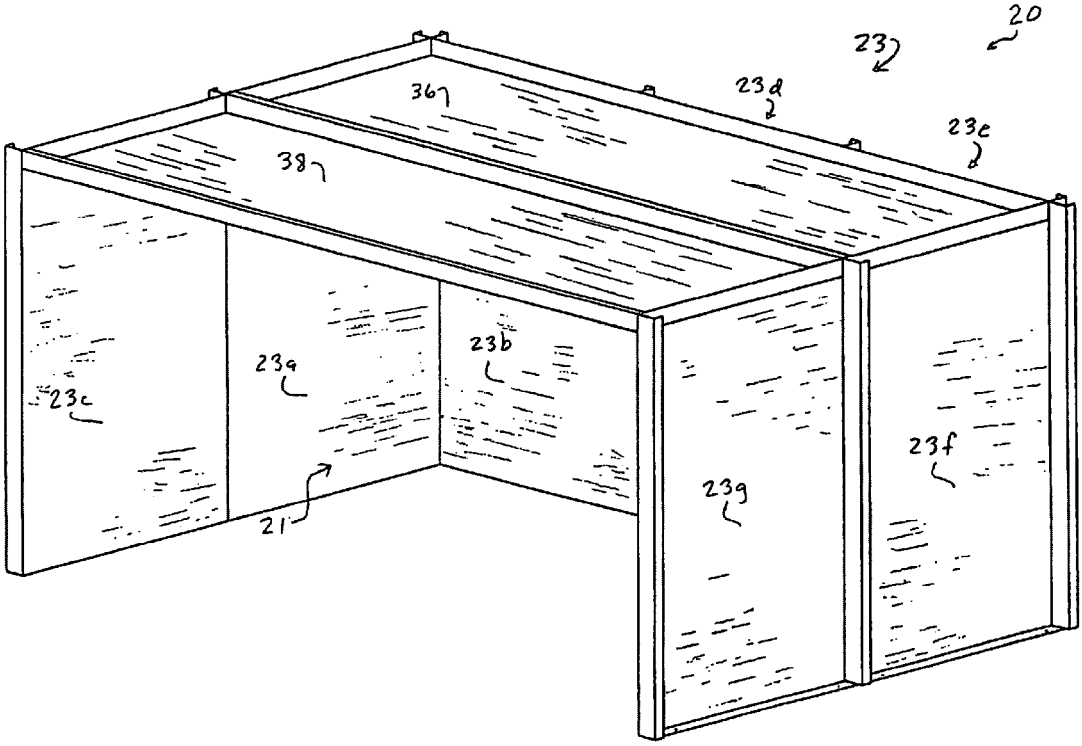
FIG. 1 is a perspective view of one embodiment of an enclosure in accordance with the present invention shown in an exemplary configuration.

The present invention is directed to a panel for an enclosure, an enclosure, and a method of assembling the enclosure. As shown in FIG. 1, an embodiment of an enclosure is generally indicated at 20. Enclosure 20 generally bounds space 21 and is particularly well-suited for use as a spray booth enclosure 20. Booth 20 may be used to house various items, including use as a shelter for animals, or for a variety of other uses wherein a bounding structure is desired. Booth 20 is particularly useful as a spray booth wherein the articles to be coated with paint or powder, for instance, are placed within space 21. In common fashion, an operator applies the spray to the article (not shown) and generally an exhaust system (not shown) is used to ventilate the spray space area 21. Booth 20 is particularly desirable in that it may be assembled without fasteners such as bolts, rivets, nuts, clamps or other items. It may also be quickly dismantled and transported or stored, and may also be quickly enlarged or modified to accommodate any number of desired uses.

Figure 2:
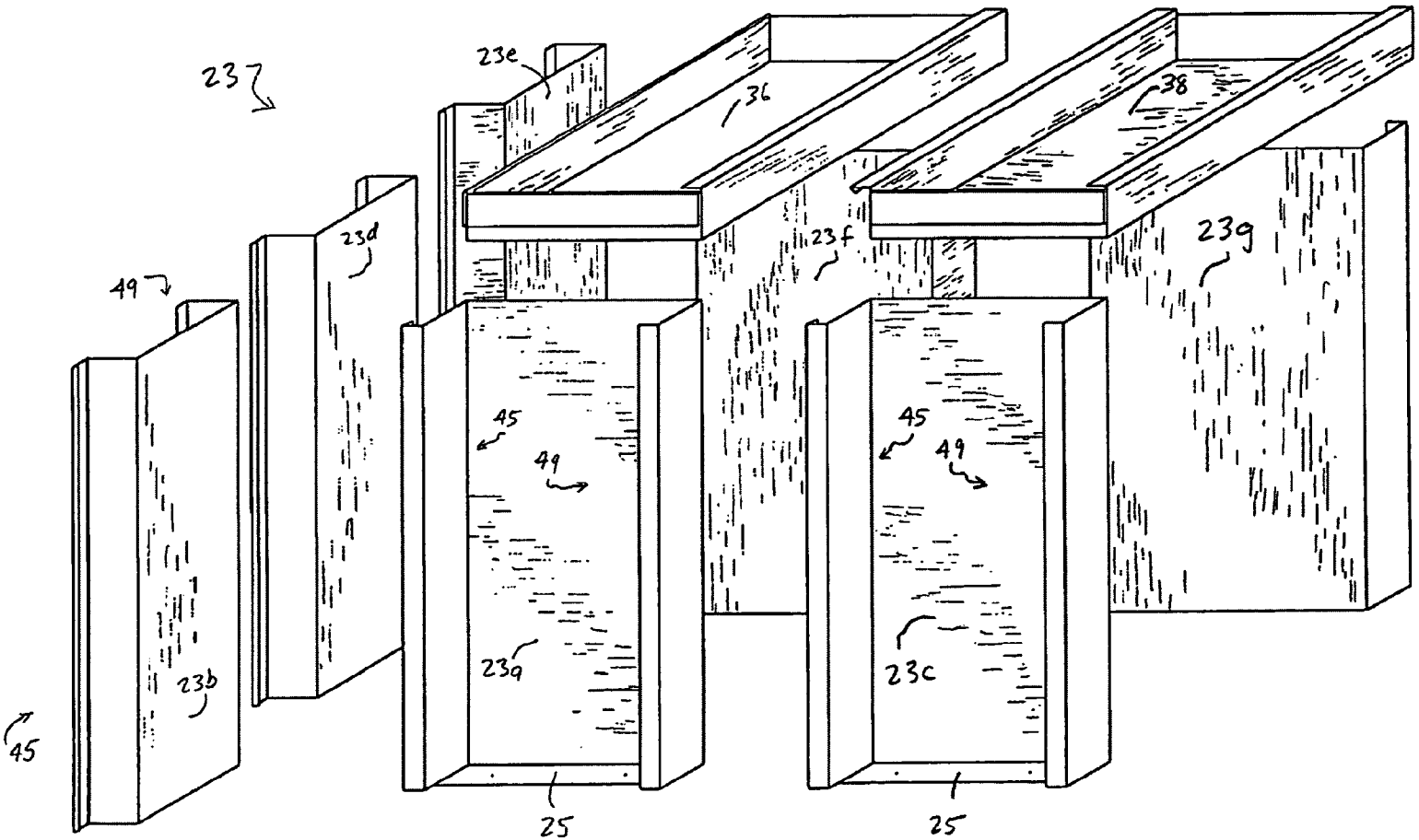
FIG. 2 is an exploded perspective view of the enclosure structure shown in FIG. 1 with various components removed for clarity.
Figure 5:
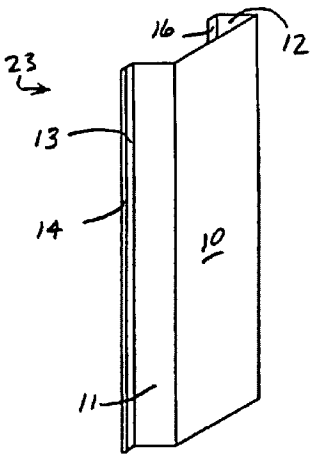
FIG. 5 is a side view of the side panel of FIG. 3.
Figure 4:
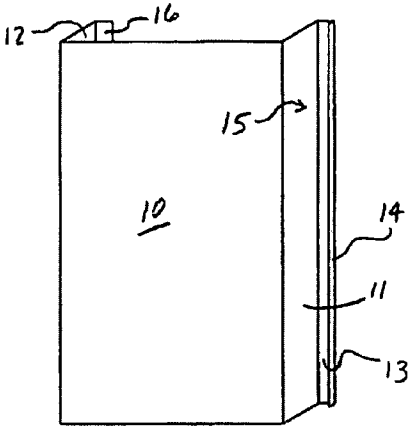
FIG. 4 is a back view of the side panel of FIG. 3.
Figure 3:
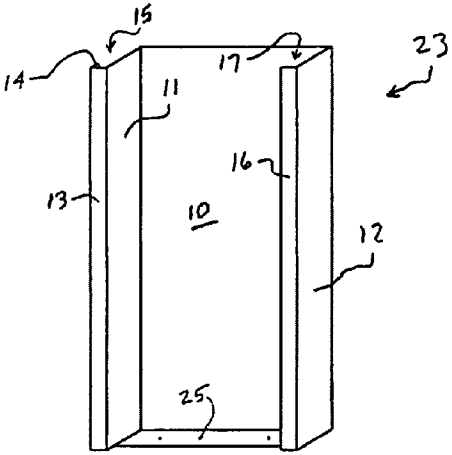
FIG. 3 is a perspective view of one embodiment of a side or wall panel of the present invention.
Figure 6:
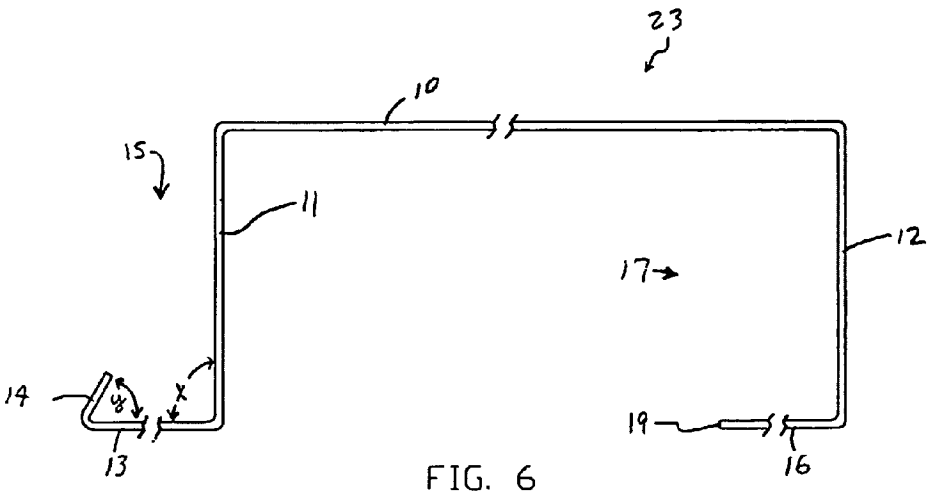
FIG. 6 is a top view of the side panel of FIG. 3.

FIGS. 1 and 2 show an exemplary configuration of the booth 20 of the present invention. It is understood that booth 20 can be configured as desired to obtain the desired shape to bound or partially bound any number of different spaces 21 or partially enclosed areas, and that the configuration shown in FIGS. 1 and 2 is illustrative only.

Booth 20 includes a plurality of panels 23 arranged in such a way so as to create a booth wall and booth top to bound space 21. Connecting two panels 23 together creates a wall or the vertical sides and/or back and/or top of the unit. Left side corner panel 23*a*, left back corner panel 23*b*, left side panel 23*c*, middle back panel 23*d*, right back corner panel 23*e*, right side corner panel 23*f* and right side panel 23*g* create one embodiment of a booth wall. It can be appreciated that panels 23, or some of them, can be modular and can include a plurality of various different panels of various different sizes and shapes which can be arranged together to create the desired booth. Panels 23 also include top edge-type panel 36 and top field-type panel 38. It can be appreciated that a plurality of various side panels, back panels and top panels (generally designated as panels 23) of varying shapes and sizes can be used to create the desired booth. Preferably panels 23 are formed of metal such as steel or aluminum, and it may be appreciated that plastics and combinations of materials may be utilized.

Panels 23 advantageously interlock and are free-standing. Panels 23 have opposite side ends which interlock with side ends of adjacent panels so that the opposing side ends of adjacent panels are interlocked together. For instance, side end 45 of panel 23*a* engages with side end 45 of panel 23*b* (as described below); and side end 49 of panel 23*a* engages with side end 45 of panel 23*c*. It can be appreciated that multiple panels 23*c* can be engaged with successive panels 23*c* to create an extended booth wall structure. It further can be appreciated that multiple panels 23*d* can be interlocked together to create any desired width of a booth structure. Moreover, the length or height of the panels 23 can be varied to accommodate a desired configuration. While not required, panels 23 are preferably modular for connecting with other like-structure panels.

Referring now to FIGS. 3-6, each panel 23 *a-g* has a relatively thin, flat, rectilinearly configured base member 10 of a predetermined area, a first rectilinear side member 11 preferably extending substantially perpendicularly from one edge thereof, and a second rectilinear side member 12 preferably extending substantially perpendicularly from an opposite edge thereof, and in the same direction with respect to the base member 10 as the first side member 11. A first lip 13 preferably extends substantially perpendicularly from the first side member 11 outwardly away from the field of the base member 10 and at an angle "x" (preferably about 90 degrees), and a second lip 14 extends from an outward edge of the first lip 13 at an angle "y" (between about zero and 90, degrees; preferably about 45 degrees) toward the base member 10, thereby defining a first connection channel 15. A third lip 16 preferably extends substantially perpendicularly from the second side member 12 inwardly towards the field of the base member 10 to define a second connection channel 17. The base member 10, first side member 11, second side member 12, and lips 13, 14 and 16 are preferably substantially flat and have predetermined areas and thicknesses. An optional footer 25 extends from an edge of base member 10 to provide additional self-standing support for use as a side panel.

Panels 23, when linked with additional panels 23 form a variety of types of self-standing walls or panels, including vertically disposed walls or horizontally disposed ceilings. Panels 23 are uniquely connectable with other panels without the need for fasteners. A booth can be formed with the fastenerlessly connectable panels to include at least two vertically disposed walls and a horizontally disposed ceiling surrounding at least a partially enclosed area. In this fastenerless or fastener-free connection, there is a lack of fasteners such as bolts, screws, rivets, clamps or the like; and yet the panels and resulting booth are self-supporting. Panels 23 need not be drilled, pinned, tied, nailed, bent, deformed, clamped or otherwise fastened. With a fastenerless connection, less work is required for assembly, and since there is a lack of holes or cracks, the usual caulking of a spray booth assembly is generally avoided. The fastener-free connected panels are ideal for use as a spray booth.

In one aspect of the invention a structural member such as a wall or ceiling is assembled having a first modular panel 23 communicatively connected with at least a second modular panel 23. Preferably, panels 23 are modular.

Figure 7A:
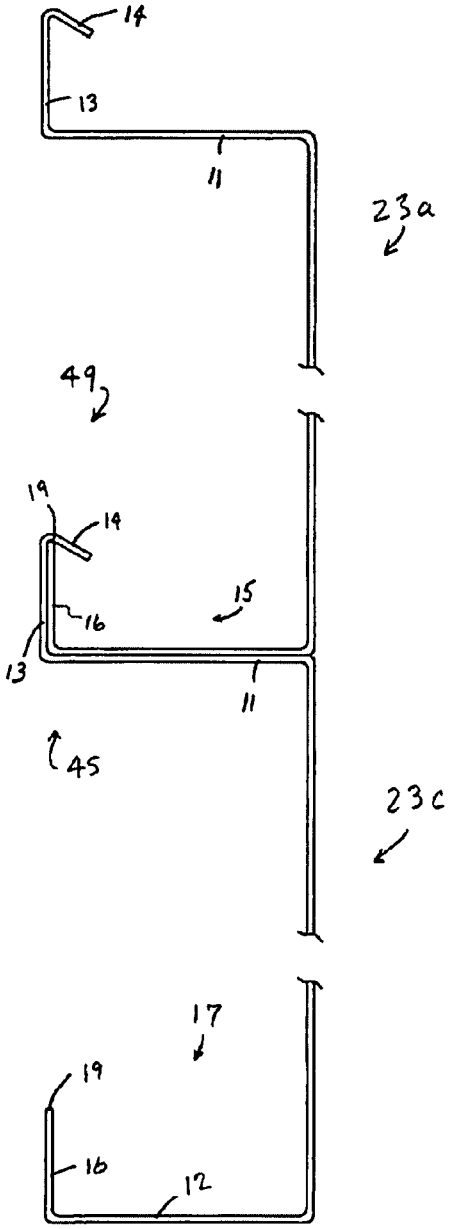
FIG. 7A is a top view of a structural member of the present invention.
Figure 7B:
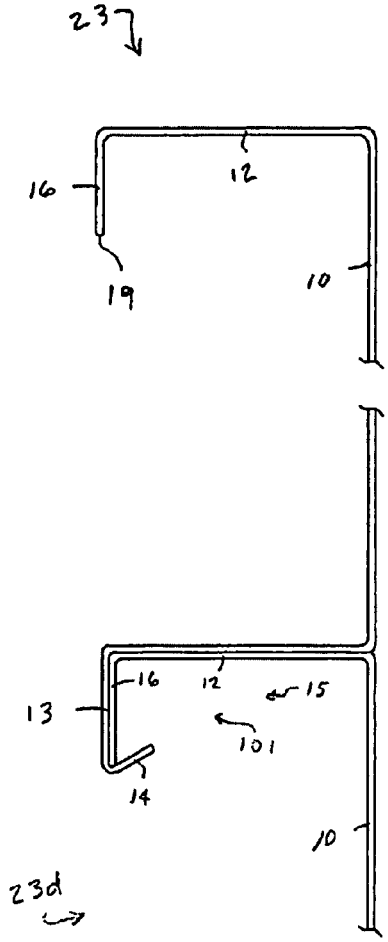
FIG. 7B is a partial top view of an alternative structural member of the present invention.

Referring to FIGS. 7A and 7B, adjacent panels 23*a*, 23*c* connect where lip 16 of one panel 23*a* is positioned within channel 15 of an adjacent panel 23*b*. Preferably a tip portion 19 of lip 16 abuts with second lip 14 of panel 23*c* for a secure connection. While the connection may be accomplished by lifting one panel 23 over an adjacent panel 23 and sliding the panel and lip 16 downward within channel 15, the preferred connection is to rotationally engage adjacent panels 23. For instance, while a first panel 23*a* remains relatively stationary, an adjacent panel 23*c* is positioned such that lip 16 of panel 23*a* inserts into channel 15 of panel 23*c*. Second lip 14 of panel 23*c* is thereby extending within second channel 17 of the first panel 23*a*. An assembler rotates second panel 23*c* (or first panel 23*a*, or both) such that lip 16 of panel 23*a* engages with lip 13 of panel 23*c*. Preferably, tip portion 19 of first panel 23*a* abuts second lip 14 of second panel 23*c* for secure engagement. Second lip 14 configured at an acute angle with respect to lip 13 inhibits lip 16 from movement within channel 15.

Figure 8:
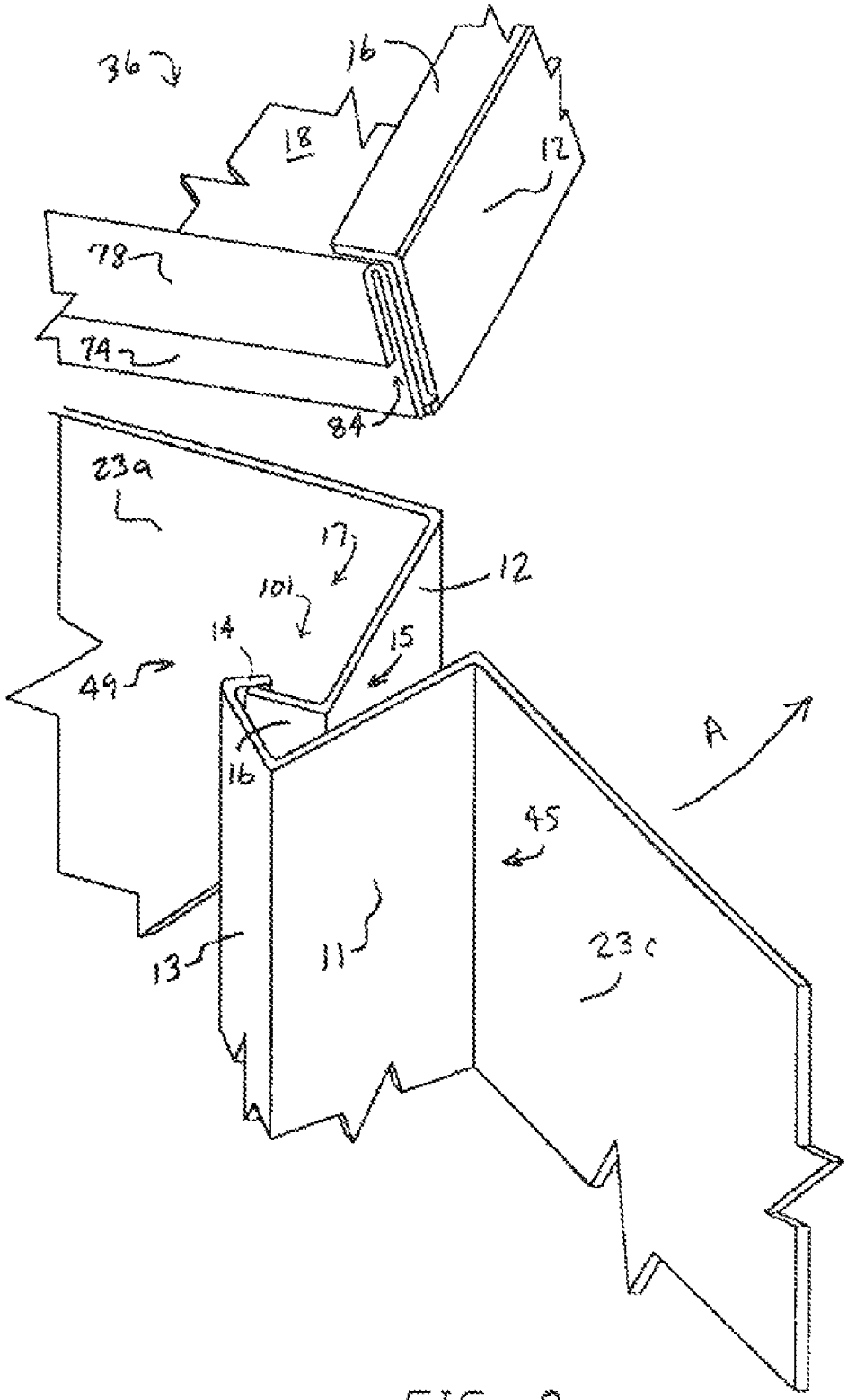
FIG. 8 is a partial perspective view of the structural member and top panel or ceiling of the present invention.

The panels may be connected to form a vertically disposed wall or a horizontally disposed ceiling as desired. Referring to FIG. 8 side panel 23*a* may be selectively arranged in series with an opposing side panel 23*c*. Side end 49 engages with side end 45 to connect the adjacent side panels. Side panel 23*a* includes second side member 12 which extends substantially perpendicular to side panel 23*a*. Third lip 16 extends substantially perpendicular from side member 112 and together form channel 117 which preferably runs the majority of the length or height of panel 22*a*. Side panel 23*c* includes channel 15 defined by lip 13 and first side member 11. Second lip 14 is attached to first lip 13 at an acute angle with respect to first lip 13. Applicant has found that providing second lip 14 at an angle of 90 degrees or greater with respect to first lip 13 will provide unsatisfactory results in that side panels 23 will tend to become disengaged. Preferably second lip 14 is positioned at a 45 degree angle with respect to lip 13. Channel 15 runs the majority of the length or height of panel 23 to thereby sufficiently interlock with adjacent panels. In assembly, lip 16 is inserted into channel 15 at channel opening 101 such that second lip 14 projects into channel 17. Channel opening 101 is defined by first side member 11 and second lip 14. Panel 23*c* is rotated in the direction of Arrow A to accommodate engagement of the adjacent side panels 23*a*, 23*c* in co-linear orientation. It may be appreciated that multiple panels 23*c* may be provided to form a structural member; and such panels are preferably modular as described above. A top or ceiling panel 36 may also be included with the panels and wall of the invention as shown in FIG. 8 and also as describe later in greater detail.

FIG. 7B illustrates a flipped arrangement of the wall shown in FIG. 7A. It may be appreciated that the arrangement of FIG. 7B may be used as an alternative for the wall of FIG. 7A. Further, the arrangement of FIG. 7B can be utilized, for instance, at a location opposite the arrangement of FIG. 7A when constructing an enclosure such as that of booth 20. In one aspect the arrangement of FIG. 7B shows lip 16 of panel 23*d* abutting second lip 14 of panel 23 to interlock panels 23*d*, 23.

Figure 20:
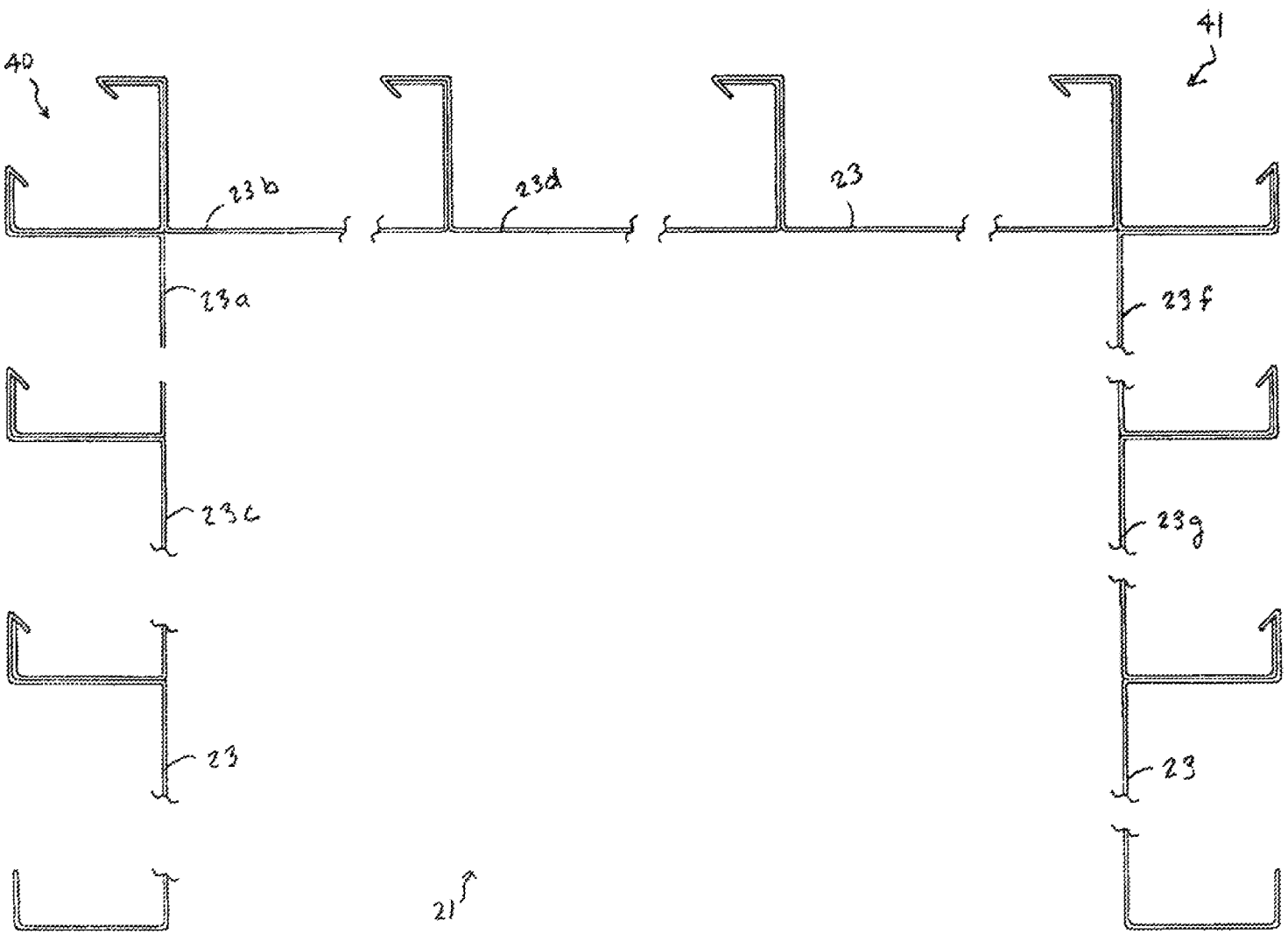
FIG. 20 is a top view of a portion of the structure in accordance with the present invention.

At least two panels 23, for instance panel 23*a* and panel 23*c*, may be connected to form a generally linearly configured wall as shown for instance in FIGS. 1, and 20. It may be appreciated that multiple panels 23 may be connected to adjacent panels 23 to create a desired structural member. At least two panels 23 may also be connected to form an angled wall having a least one corner.

Referring now to FIGS. 9A, 9B and 10A, 10B, an "edge-type" panel 36 and a "field-type" panel 38 are shown, respectively. Panels 36 and 38 are horizontally disposed top or ceiling panels. Panel 38 is modular for connection with other panels. Panel 36 is "edge-type" panel in that it is preferably placed at an edge position of a structure as shown in FIG. 1. Panel 38 is "field-type" in that it is preferably placed within the field or at internal or intermediate locations with respect to an edge position. It may be appreciated that panel 38 includes those features of base member 10 and panel 23 described above, and variations thereof.

Figures 9A, 9B, 10A, 10B:
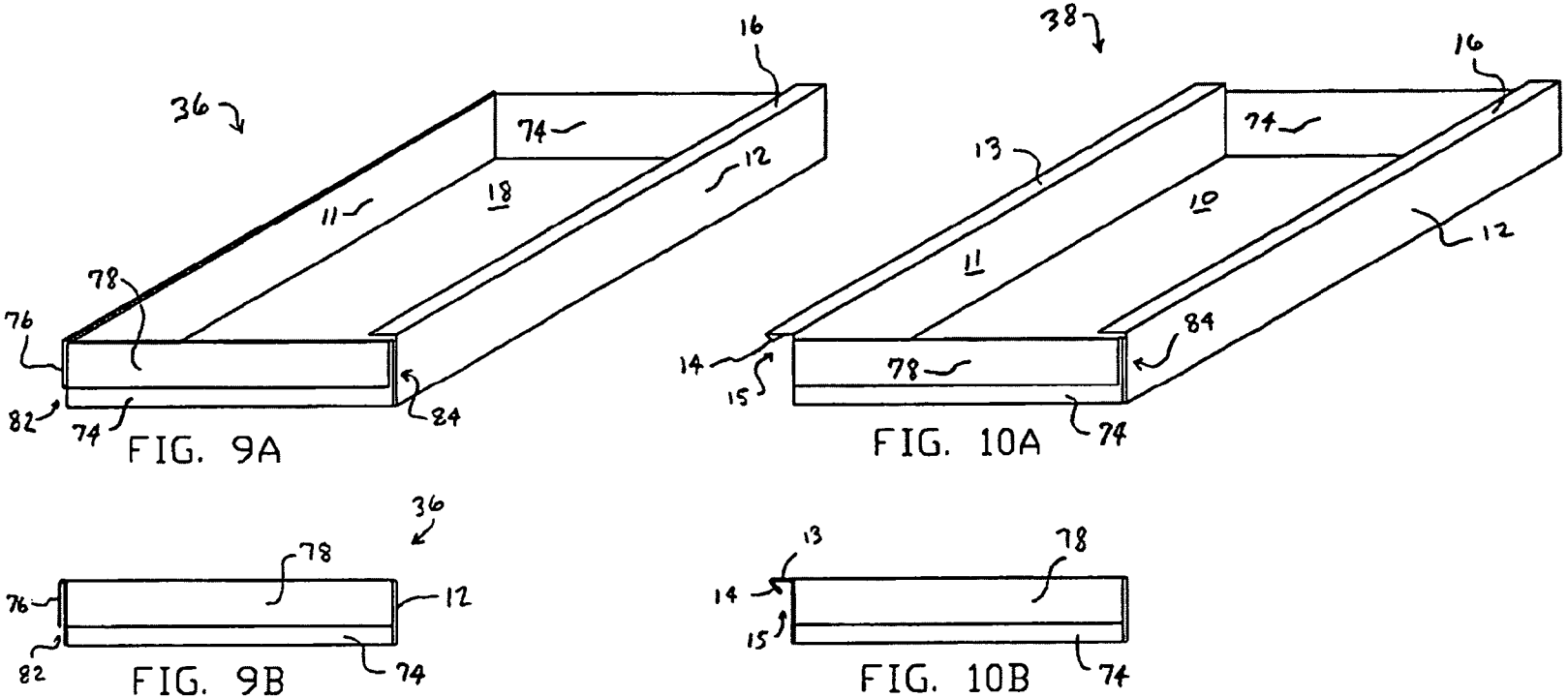
FIG. 9A is a perspective view of one embodiment of a top or ceiling panel of the present invention.
FIG. 9B is a side view of the panel of FIG. 9A.
FIG. 10A is a perspective view of another embodiment of the top or ceiling panel of the present invention.
FIG. 10B is a side view of the panel of FIG. 10A.
Figure 11:
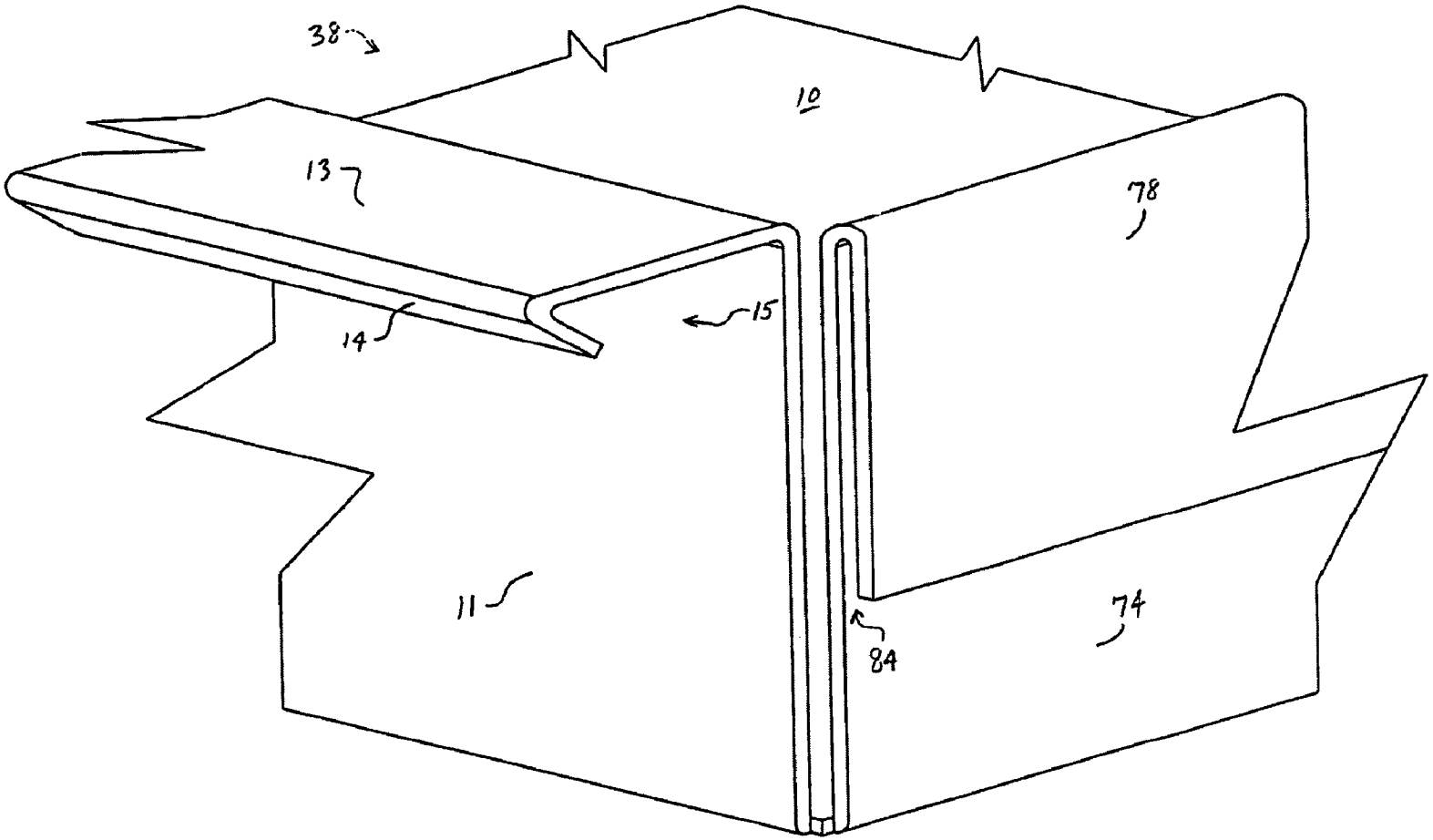
FIG. 11 is partial perspective view of a top or ceiling panel of the present invention.

Panel 38 as shown in FIGS. 10A, 10B and 11 further includes mutually opposed shoulder walls 74 extending generally perpendicularly from opposite edges of the relatively thin, flat, rectilinearly configured base member 10 of a predetermined area. Each shoulder wall 74 preferably includes a slot wall 78 extending from the shoulder wall 74 toward base member 10. Shoulder wall 74 and slot wall 78 define a slot 84. Preferably slots 84 are provided at opposite edges of panel 38 for connection with side or wall panels 23. Panel 38 is connectable with other panels 38 and/or 23 without fasteners to form a horizontally disposed top wall or ceiling. Panel 38 connects to an adjacent horizontally oriented panel 23 by positioning lip 16 within channel 15. Preferably, a tip portion 19 of lip 14 abuts with a corner of an adjacent panel 23 where lip 13 meets with second lip 14. Lip 14 extends from an outward edge of the first lip 13 at an angle between about zero and 90 degrees, and preferably about 45 degrees. Preferably, lip 16 engages within a majority of the length of channel 15. Channel 15 may be rotationally engaged with lip 16 to provide secure connection. Panel 38 may connect with similar panels 38, including an edge type panel 36. It may be appreciated that a panel 23, such as panel 23*a*, may be horizontally oriented for use as a top panel 38; however, top panel 38 includes slots 84 for overlay engagement with panels 23, and typically does not include a footer 25.

Panel 36 as shown in FIG. 9A includes mutually opposed shoulder walls 74 extending generally perpendicularly from opposite edges of the relatively thin, flat, rectilinearly configured edge base member 18 of a predetermined area. Each shoulder wall 74 preferably includes a slot wall 78 extending from the shoulder wall 74 toward base member 18. Shoulder wall 74 and slot wall 78 define a slot 84. Preferably slots 84 are provided at opposite edges of panel 36 for connection with side or wall panels 23. A first rectilinear side member 11 preferably extends generally perpendicularly from one edge of base member 18, and a second rectilinear side member 12 preferably extends generally perpendicularly from an opposite edge thereof, and in the same direction with respect to the base member 18 as the first side member 11. A lip 16 preferably extends substantially perpendicularly from the second side member 12 inwardly towards the field of the base member 18 to define a connection channel 17. As shown in FIG. 9B, a slot wall 76 extends downwardly from side member 11 toward base member 18 and defines a slot 82, preferably running the length of base member 18. Slot 82 connects with a vertically disposed side or wall panel, such as panel 23*b* at a back portion of an enclosure. Lip 16 preferably connects with an adjacent horizontally disposed top panel 38 at a channel 15. No fasteners are required for the connection. Slot wall 76 of panel 36 may include edge gaps (not shown) for desired clearance fitting around first side members 11 and/or second side members 12 of vertically oriented panels 23 (such as panels 23*b*, 23*d*, 23*e*) at a back portion of the enclosure.

It may be appreciated that multiple panels 23 may be connected without fasteners to form a booth 20 with at least two vertically disposed walls and a horizontally disposed ceiling surrounding at least a partially enclosed area. Such booth is ideal for use as a spray booth.

Figure 12:
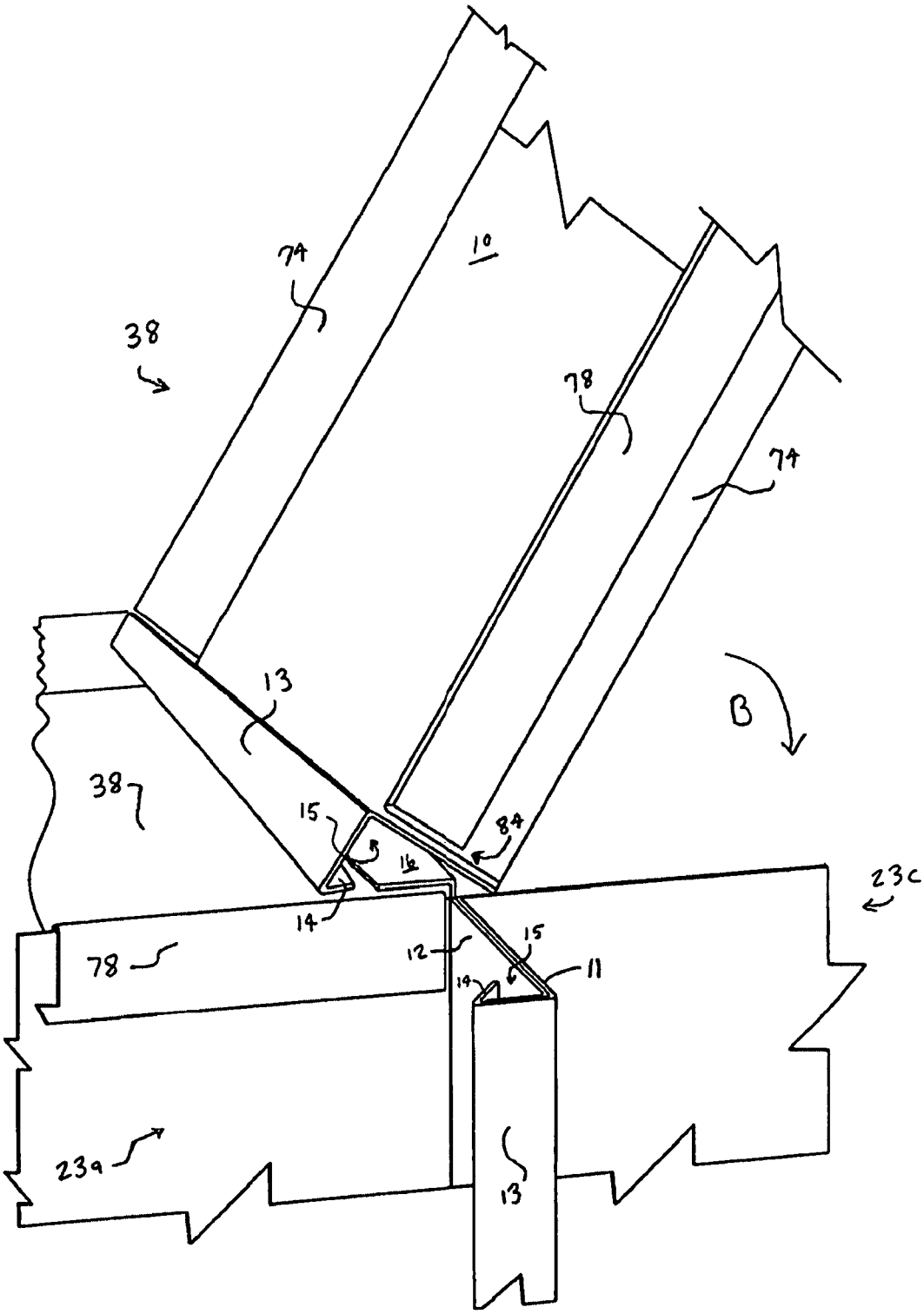
FIG. 12 is a partial perspective view of an embodiment of the enclosure in accordance with the present invention in partial assembly.
Figure 13:
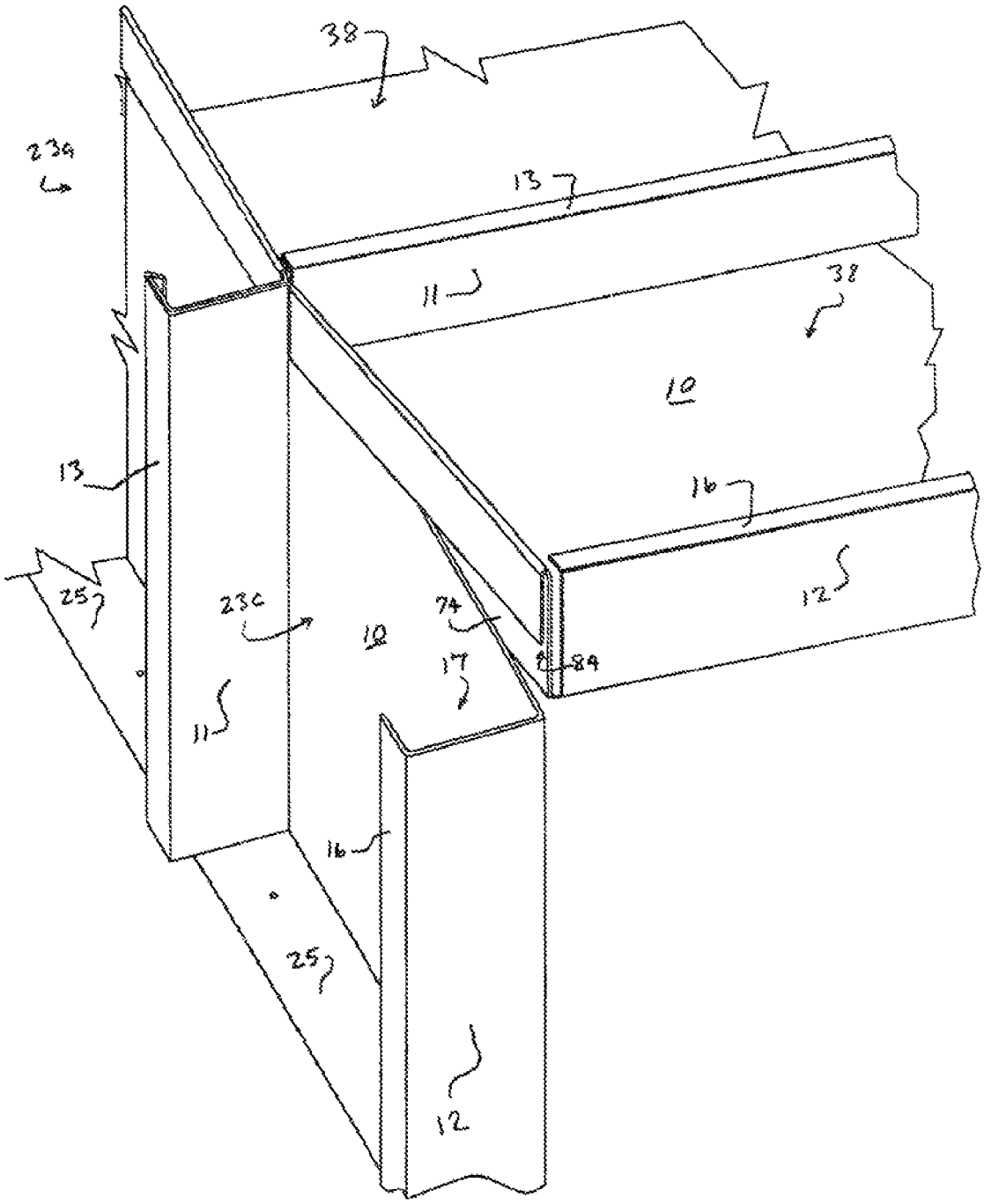
FIG. 13 is a partial perspective view of the structure of FIG. 12 in partial assembly.

As shown in FIGS. 12 and 13, top panel 38 includes shoulder wall 74 and slot wall 78 defining slot 84. Slot 84 drops over side wall 23 for secure engagement. Second lip 14 is attached to first lip 13 at an acute angle with respect to first lip 13. Lip 13, lip 14 and side member 11 define channel 15. Second lip 14 inhibits panel 38 from movement. Channel 15 runs the majority of the length or width of panel 38 to provide for solid secure engagement with adjacent top panel 36 or other panels 38.

In assembly, top panel 38 drops over to engage side panel 23 and also engages with top panel 36 (or 38) at channel 15 by receiving lip 16. Panel 38 preferably moves in the direction of arrow B as shown in FIG. 12 for locking engagement. Preferably, lip 16 abuts lip 14 for secure connection. FIG. 13 shows panel 38 in nearly complete engagement with panel 38, 23*a* and 23*c*. It can be appreciated that panel 38 also engages with panel 36, and other panels 23. In position, top panel 38 prevents side panel 23*c* from rotating outward from its engaged position with side panel 23*a*. Further, first lip 13 provides substantial cross support for a top or ceiling of booth 20 for rigid free-standing and sturdy alignment. Lip 13 provides structural support so that top panels 38 may be equipped with components for use as a spray booth, specifically, lights, exhausts vents or fans, or other components (not shown) which may necessarily be placed in or on panels 23 or otherwise on top of booth 20.

It may be appreciated that the aspects of the invention referenced in FIGS. 7A, 7B, and 8 may accommodate a booth structure having panels 23, yet lacking a post such as post 40. A variety of corner configurations and or posts can be utilized for an enclosure, while still recognizing the independent benefits derived from side panels 23 configured with the acutely angled second lip 14 as described. Moreover, such arrangement in conjunction with a top panel 38 provides for efficient and stable co-linear arrangement of panels 23 for a booth structure 20.

Figure 15:
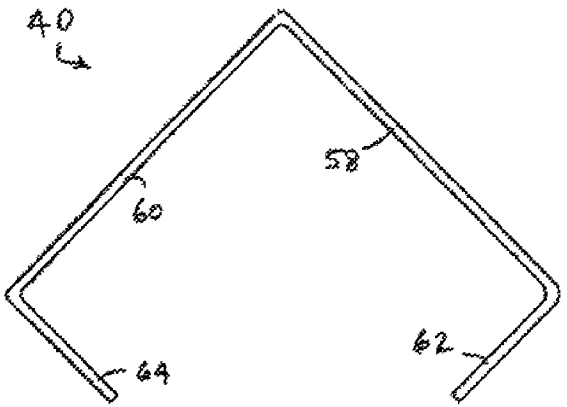
FIG. 15 is a top view of the post of FIG. 14.
Figure 14:
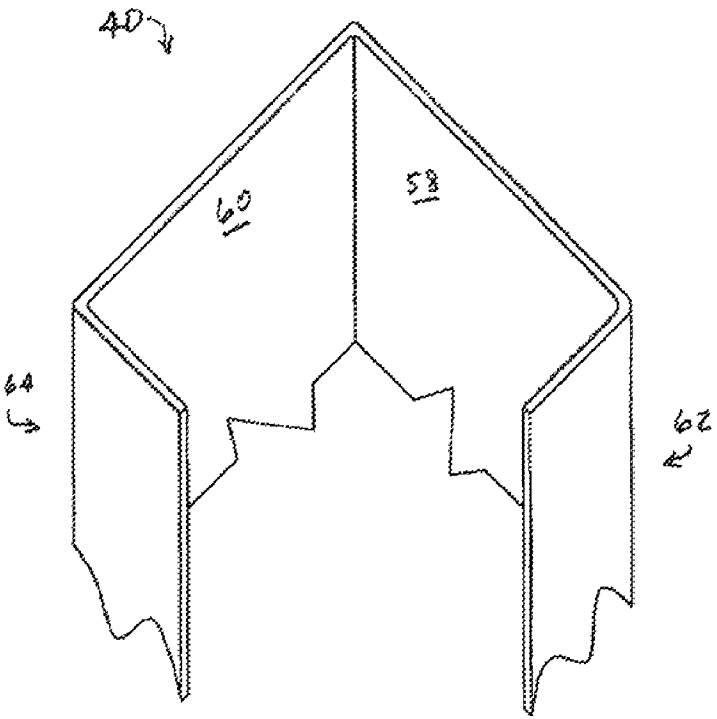
FIG. 14 is a perspective view of one embodiment of a post of the present invention.
Figure 16:
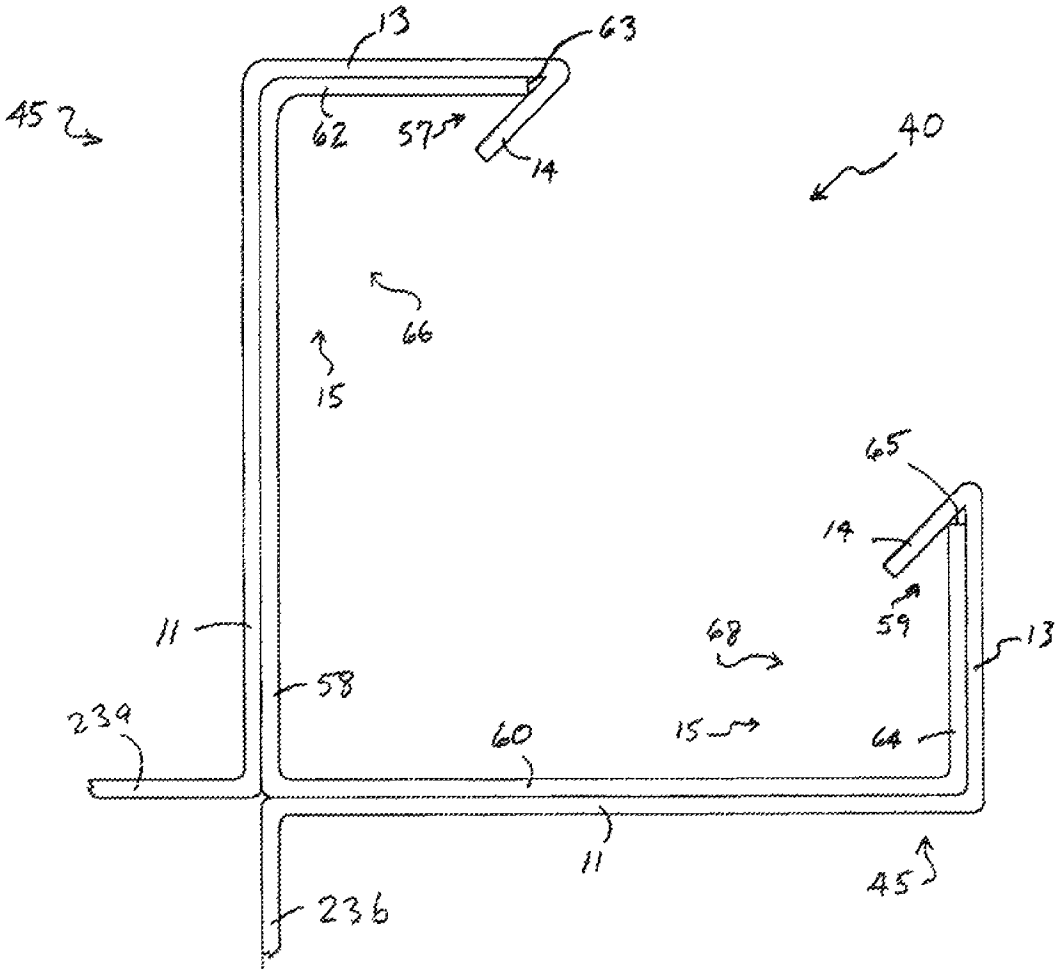
FIG. 16 is a top view of a portion of the structure of the present invention.
Figure 17:
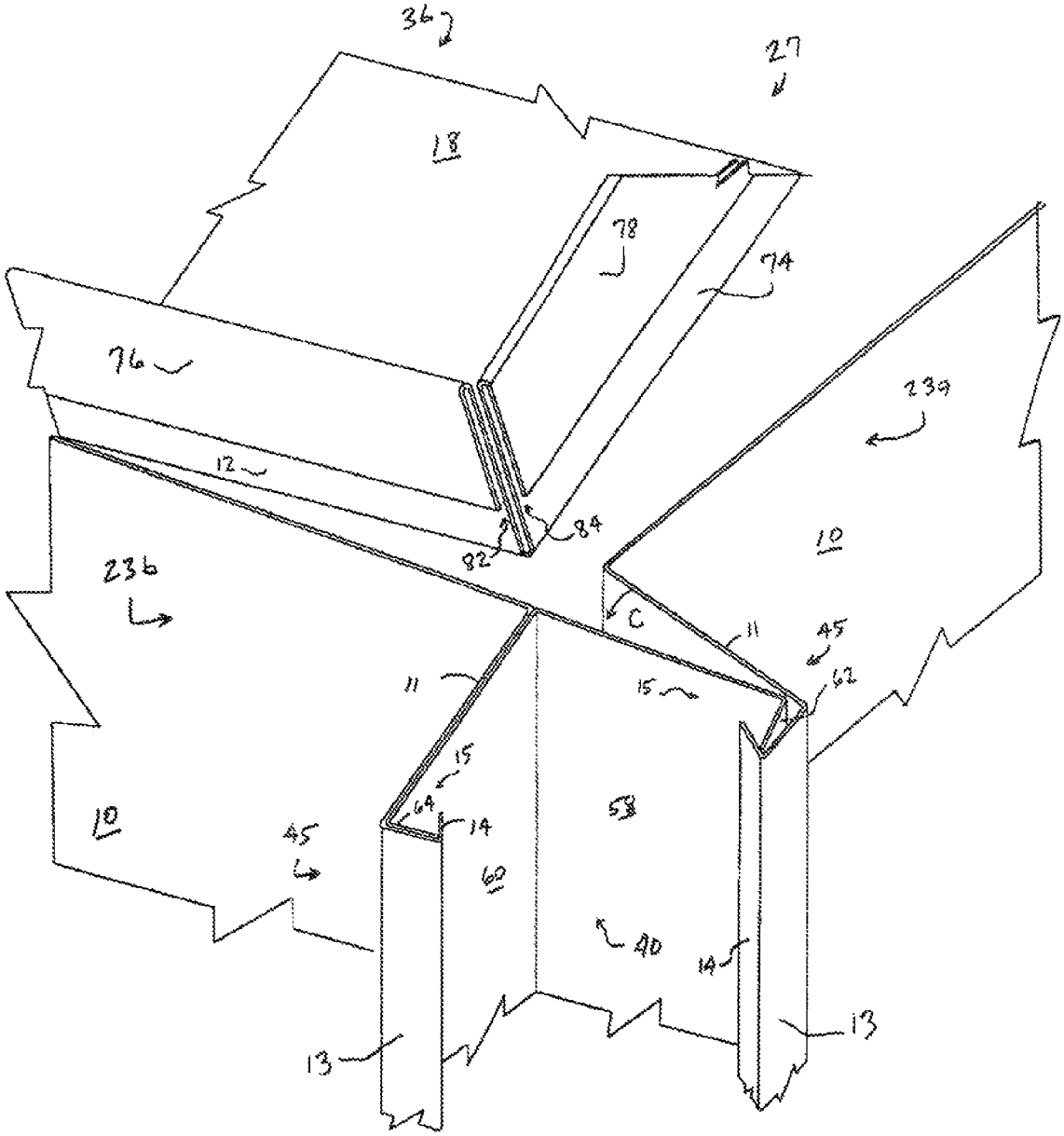
FIG. 17 is partial perspective view of a portion of the enclosure of the present invention.
Figure 18:
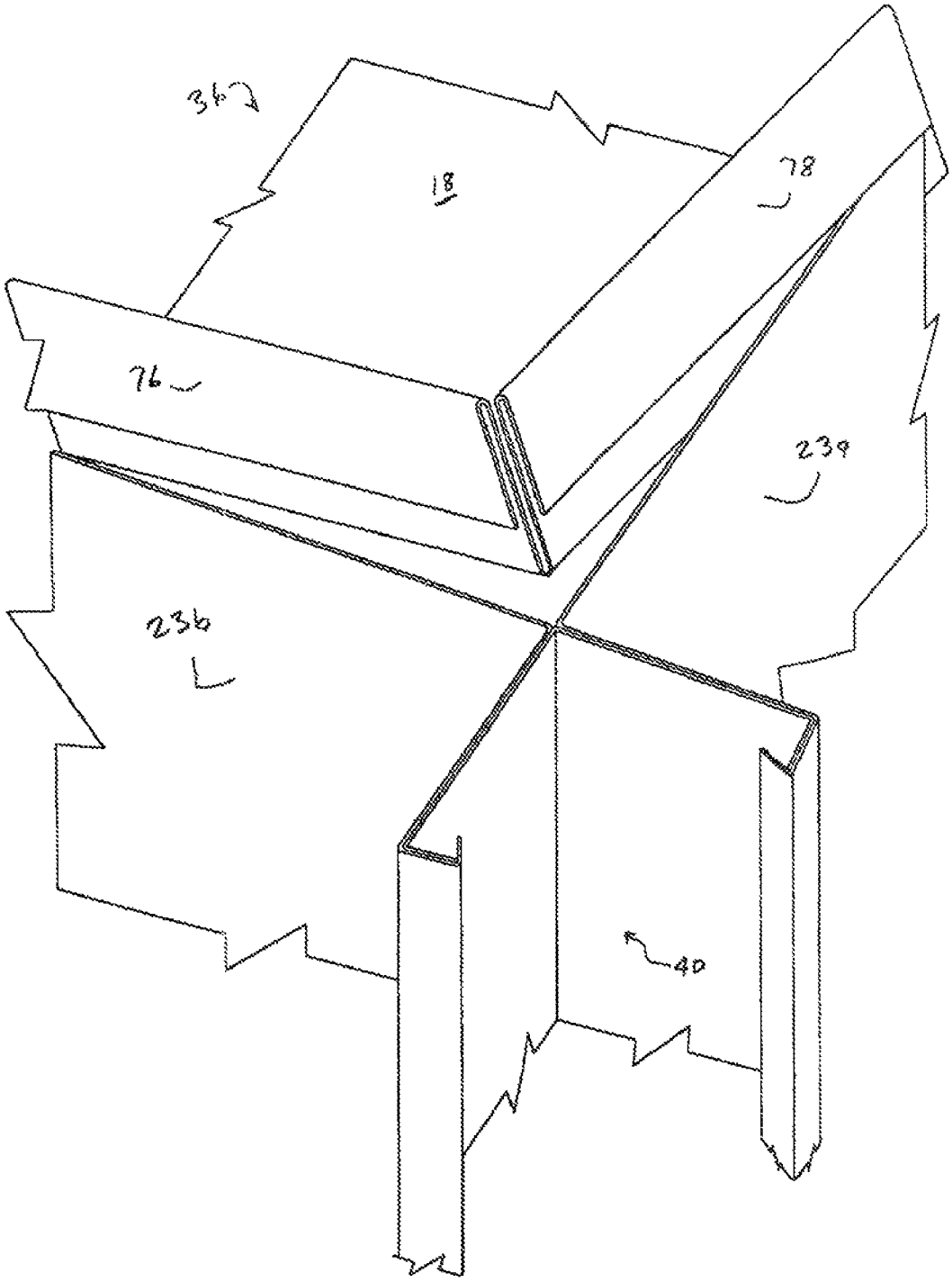
FIG. 18 is a further partial perspective view of the enclosure of FIG. 17.

Referring now to FIGS. 14, 15, and 16, a post and a corner configuration aspect of the invention are shown. A generally winged-L-shaped post 40 includes rectilinear post walls 58, 60 extending substantially perpendicularly from each other. Post walls 58, 60 are preferably rectilinear and connect with each other to form a generally L-shaped configuration. Rectilinear post wings 62, 64 extend substantially perpendicularly from post walls 58, 60 and toward each other. Preferably, post walls 58, 60 are perpendicular to each other, and post wings 62, 64 are perpendicular to the respective post walls 58, 60. Corner post 40 couples together two panels 23*a*, 23*b* in a substantially perpendicular orientation. Post wing 62 engages with channel 15 of an adjacent panel 23*a*. Preferably post 40 is rotationally engaged within channel 15 by movement of panel 23*a* in the direction of arrow C as shown in FIG. 17. A similar engagement is accomplished with respect to post wing 64 and panel 23*b* to couple together panels 23*a* and 23*b*.

Referring to FIG. 17, panel 36 engages with the wall structure of panels 23. Slot 82 drops over the edge of panel 23*b* at a back portion of the enclosure for secure engagement while slot 84 drops over the edge of panel 23*a* at a side portion of the enclosure. It may be appreciated that panel 23*a* is rotated into position as shown by arrow C prior to drop-down of panel 36. Panels 23*a* and 23*b* form a structural member and together with post 40 form a self-supporting fastener-less corner structural member and enclosure. Together with panel 36 the self-supporting structural member and enclosure is further stabilized and fastenerlessly locks the panels 23*a* and 23*b* into position.

In one aspect of the invention, an enclosure 27 includes at least two panels 23 of a modular variety as described above and at least one corner post 40 communicatively connected to the two modular panels 23 to cooperate to form at least two walls. Additional modular panels 23 may be connected to form a linearly configured wall; and at least one ceiling panel 36, 38, may be connected to the two walls. In a further aspect, a self supporting, fastenerless spray both includes at least one wall having at least two modular wall panels as described herein, and at least one ceiling having at least one panel as described herein. One of the ceiling panels is preferably an edge-type panel 36.

Post 40 is a generally "winged-L-shaped" coupler as shown, which cooperates with channels 15 of opposing panels 23*a*, 23*b* to removeably couple the side panels together. Post 40 includes post walls 58, 60 arranged substantially perpendicularly to each other in a generally L-shaped cross section, and post wings 62, 64 positioned at a substantially perpendicular orientation with respect to post walls 58, 60. As shown in FIG. 15, channel hook walls 54, 56 project generally inward toward each other or toward the intersection of post walls 58, 60.

Preferably post 40 runs a majority of the length or height, or the entire length or height, of panels 23 for interlocking the entire length or height of the side ends 45 of adjacent panels 23*a*, 23*b*.

Panels 23*a*, 23*b* each include channel openings 66, 68 defined by first side member 11, and second lip 14, respectively. Openings 66, 68 provide a clearance between the end of second lip 14 and side member 11. The clearance has a length shorter than the length of post wings 62, 64. Preferably, post wings 62, 64 abut second lip 14 when post walls 58, 60 are positioned against side members 11. In such configuration, panels 22*a*, 23*b* are sufficiently interlocked so as to inhibit movement. Post wings 62, 64 also preferably abut first lips 13 in such configuration. Preferably post wings 62, 64 abut second lips 14 at post wing ends 63, 65. First lip 13 and second lip 14 define hook-corners 57, 59 where post 40 is engaged with side panels 23*a*, 23*b* at the hook corners 57, 59.

For assembly, post 40 is inserted into channel openings 66, 68. Preferably channels 15 run a majority of the length or height, or the entire length or height, of panels 22 for interlocking the entire length or height of the side ends 45 of adjacent panels. Post wing 62 engages with first lip 13 and abuts second lip 14 of panel 23, while post wall 58 is positioned against side member 11. Preferably, post 40 rotationally engages within channels 15. In assembly, an operator may select to first receive post 40 within channel 15 of panel 23*a*, and then proceed to secure post 40 to adjacent panel 23*b*. Alternatively, an operator may select to first receive post 40 within channel 15 of panel 23*b* as described below, and then receive post 40 within channel 15 of panel 23*a*. While not preferred, as an alternative to rotationally engaging together post 40 and channels 15, an operator may position panel 23 so as to slide panel 23 at channel 15 downward to engage post wing 62; however, this requires lifting, stabilizing and drop-placement of the panel.

In order to insert post wing 62 into channel opening 66, post 40 is preferably rotated to allow post wing 62 sufficient clearance to enter the opening 66. Otherwise, post wing 62 would abut second lip 14 and prevent insertion of post wing 62 into hook corner 57. It may be appreciated that either post 40 or panel 23, or both, may be rotated to achieve the desired engagement; and reference herein to post 40 rotating for engagement is equivalent to having a panel rotated. It may also be appreciated that an assembler may begin assembly by receiving post 40 within channel 15 and thereafter secure post 40 to the adjacent side panel 23*a* (as is reflected in FIG. 17), or begin by receiving post 40 within channel 15 of panel 23*a* and thereafter secure post 40 to the adjacent side panel 23*b*. Thus, assembly may be achieved in a variety of steps in keeping within the scope of the present invention.

In one instance, post wing end 63 is introduced first within channel opening 66 and positioned to abut second lip 14 at hook corner 57. Post wing 62 thereby inhibits movement of panel 23 in a direction opposite post wing end 63. Further, second lip 14 inhibits post wing 62 from movement in the direction opposite panel 23*a*. A similar engagement may be obtained with respect to panel 23*b*. Post 40 is securable to an adjacent side panel 23*b* while also being rotationally engageable with channel 15 of panel 23*a* to releasably engage panel 23*a* to connect the panels together. Such rotational engagement is preferred since assembly may be accomplished by positioning the panels 23 and post 40 at the same level. It may be appreciated that the panels 23 could slide vertically into position with respect to the post 40 (i.e., by lifting a panel 23 and sliding it into the position where the post 40 inserts into channels 15. However, to do so would require lifting of the panels 23 which may require additional overhead clearance and adds an extra expense of labor and assembly difficulty to accommodate appropriate insertion. Thus, rotation of a panel 23 into position provides for an easy and quick assembly. Further, such positioning, whether rotational or by sliding, is obtained without use of screws, rivets, bolts or other fastening devices. Drilling of holes within panels 23 may be eliminated.

Figure 19:
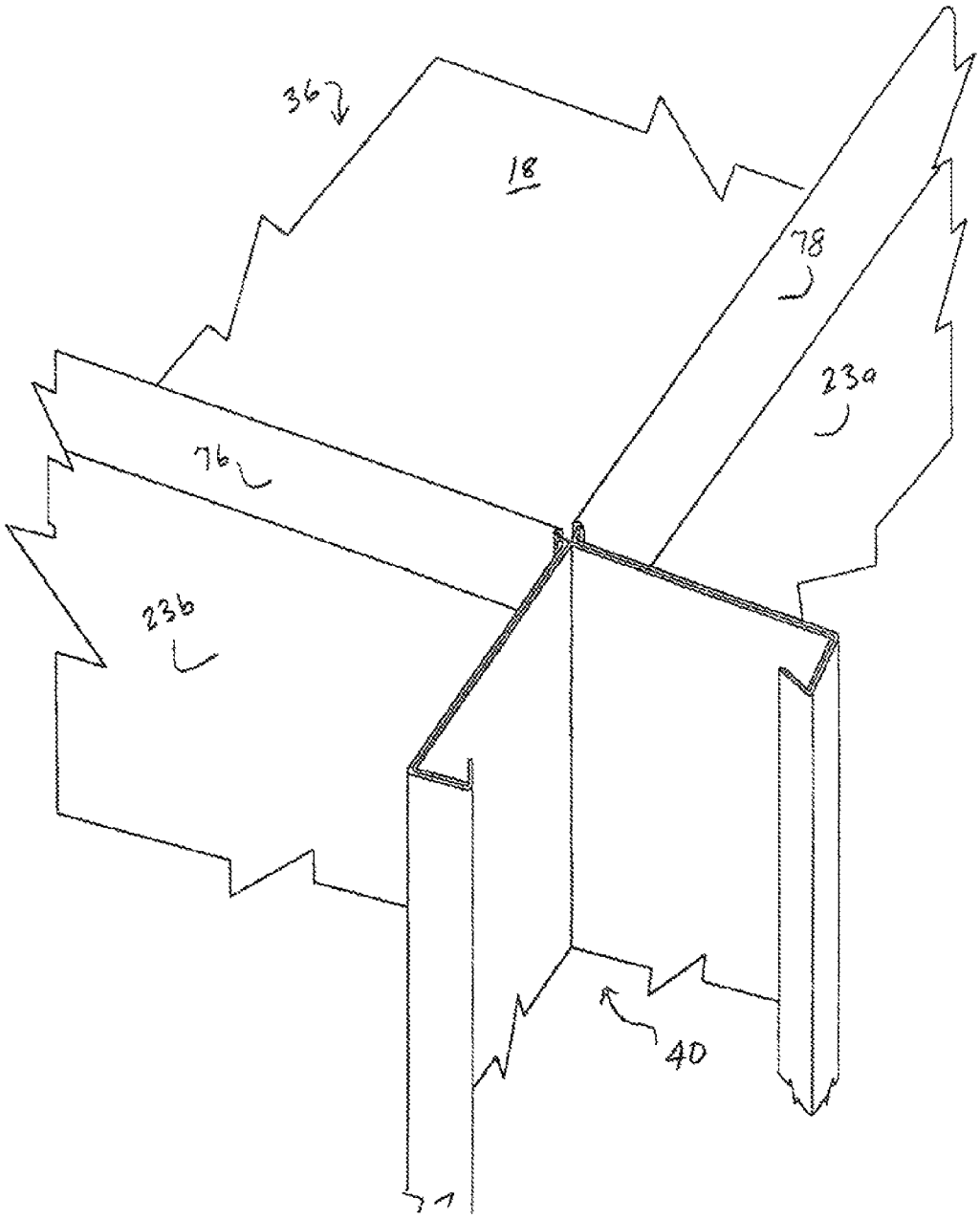
FIG. 19 is a further partial perspective view of the enclosure of FIG. 17.

As shown in FIG. 19, panels 23*a*, 23*b* have been connected with post 40 to provide a side wall structure. Thereafter, top panel 36 is applied to the structure 20 to accommodate further use, stability, and locking. Preferably top panel 36 drops over to interlock the side panels 23 together.

Referring again to FIG. 17, top panel 36 includes slots 82, 84. Slots 82, 84 are defined by shoulder walls 70, 74 and slot walls 76, 78. Slots 82, 84 are designed to drop over side panels 23. Top panel 36 is positioned over respective side panels 23, such that booth 20 includes a corner area which is firmly engaged in position and provides a sturdy, free-standing structure. With top panel 36 in position, side panels 23 are inhibited from rotating away from post 40 and are therefore interlocked into position.

Referring to FIG. 20, a further aspect of the booth 20 is shown. It may be appreciated that a plurality of panels 23 may be utilized to form any desired size of booth 20.

Figure 21:
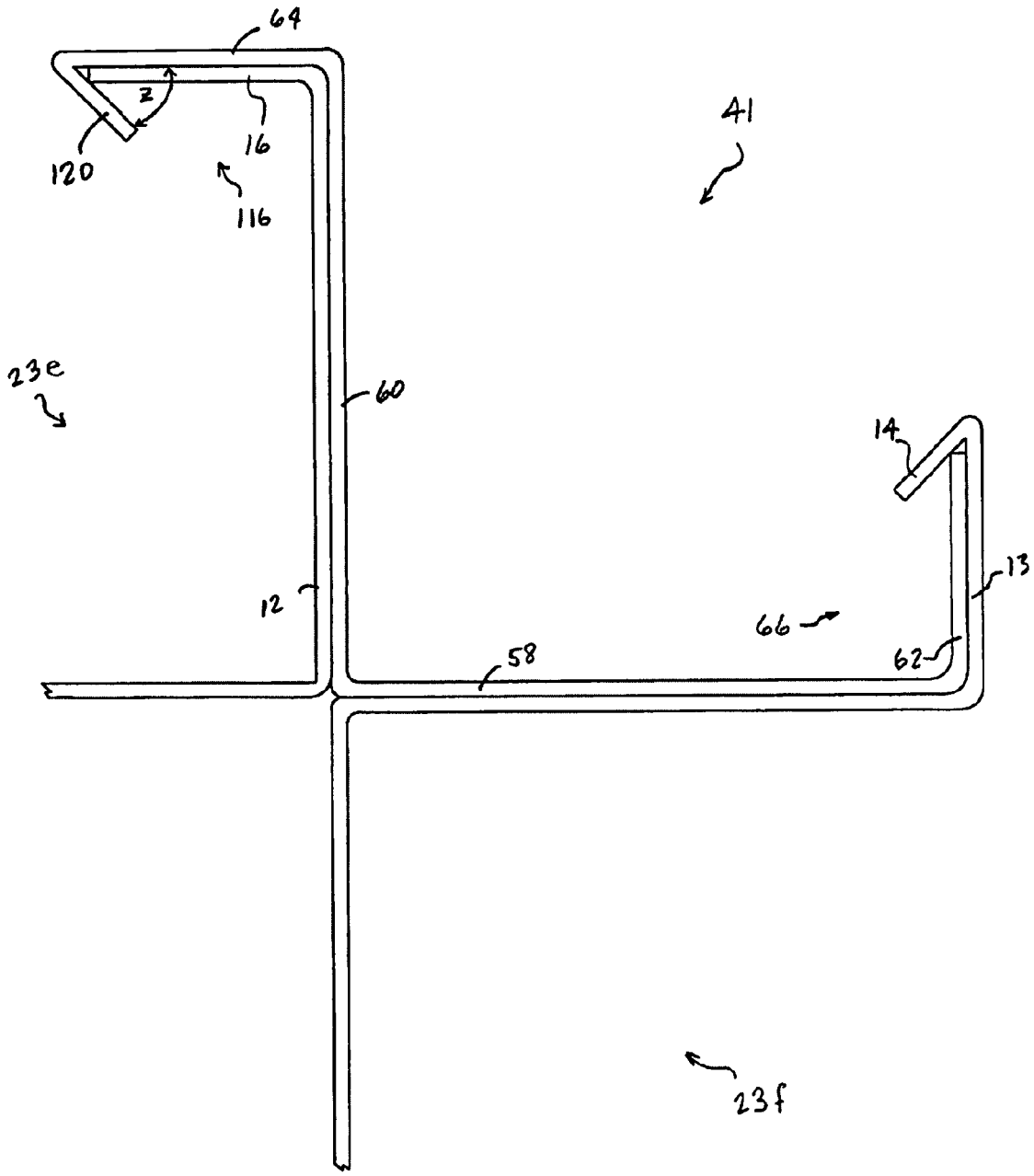
FIG. 21 is a top view of a portion of the structure in accordance with a further embodiment of the present invention.

A further embodiment of the post aspect of the invention includes post 41 for coupling two panels such as panels 23*e* and 23*f*. As shown in FIG. 21, post 41 includes post walls 58, 60 preferably oriented perpendicularly to each other. FIG. 21 shows walls 58, 60 directly connected. Each post wall 58, 60 includes a post wing 62, 64 extending substantially perpendicularly from the respective post walls 58, 60. Post wing 64 in this embodiment extends outward or away from the opposite post wall 58. Post wing 64 includes a post hook wall 120 at an angle "z" with respect to the post wing 64. Angle "z" is between about zero and 90 degrees, and preferably about 45 degrees. Post 41 is particularly useful for forming a corner opposite the corner arrangement described previously. Post wing 64, post hook wall 120, and post wall 60 define post channel 116. Preferably post channel 116 runs a majority of the length or height, or the entire length or height, of panel 23 for interlocking the entire length or height of the side ends of adjacent panels. Post channel 116 receives third lip 16 which extends from second side member 12 of panel 23. Third lip 16 abuts post hook wall 120 and inhibits separation of panel 23 from adjacent panel 23*f*. Post channel 116 is formed opposite post wing 62. Side panel 23 is rotationally engageable within post channel 116 to releasably engage side panel 23 to the side end 45 of side panel 23*f*. As shown in FIG. 21, post 41 is a generally S-shaped coupler which cooperates with opposing side panels 23, 23*f* to removeably hold the panels together.

Referring to FIGS. 22-24, further embodiments of the panel 23 and resulting structural members are shown. Panel 23*h* has a relatively thin, flat, rectilinearly configured base member 10 of a predetermined area, a first rectilinear side member 11 extending from one edge thereof, and a second rectilinear side member 12 extending from an opposite edge thereof, and in the same direction with respect to the base member 10 as the first side member 11. First member 11 extends at an acute angle with respect to base member 10. A first lip 13 extends from the first side member 11 outwardly away from the field of the base member 10 and at an angle "s" (preferably at an acute angle), and a second lip 14 extends from an outward edge of the first lip 13 at an angle "t" (between about zero and 90 degrees; preferably about 45 degrees) toward the base member 10, thereby defining a first connection channel 15. A third lip 16 extends from the second side member 12 inwardly towards the field of the base member 10 to define a second connection channel 17. The base member 10, first side member 11, second side member 12, and lips 13, 14 and 16 are preferably substantially flat and have predetermined areas and thicknesses. Panel 23*h* may be modular.

FIG. 23 shows multiple panels 23*h* configured to form a structural member. Panels 23*h* are preferably rotated into position as described previously with respect to panels 23. Both a corner arrangement and co-linear arrangement may be accomplished with panels 23*h*.

FIG. 24 shows a further embodiment of post 140 having a rectilinear post wall 158. Post wings 162, 164 extend toward each other from opposite ends of the post wall 158. Each post wing 162, 164, is positioned at an acute angle with respect to the post wall, and are preferably oriented perpendicularly with respect to each other. In assembly, post wing 164 preferably abuts second lip 14 of panel 23*h*. A similar abutment occurs with respect to post wing 162.

Figure 25:
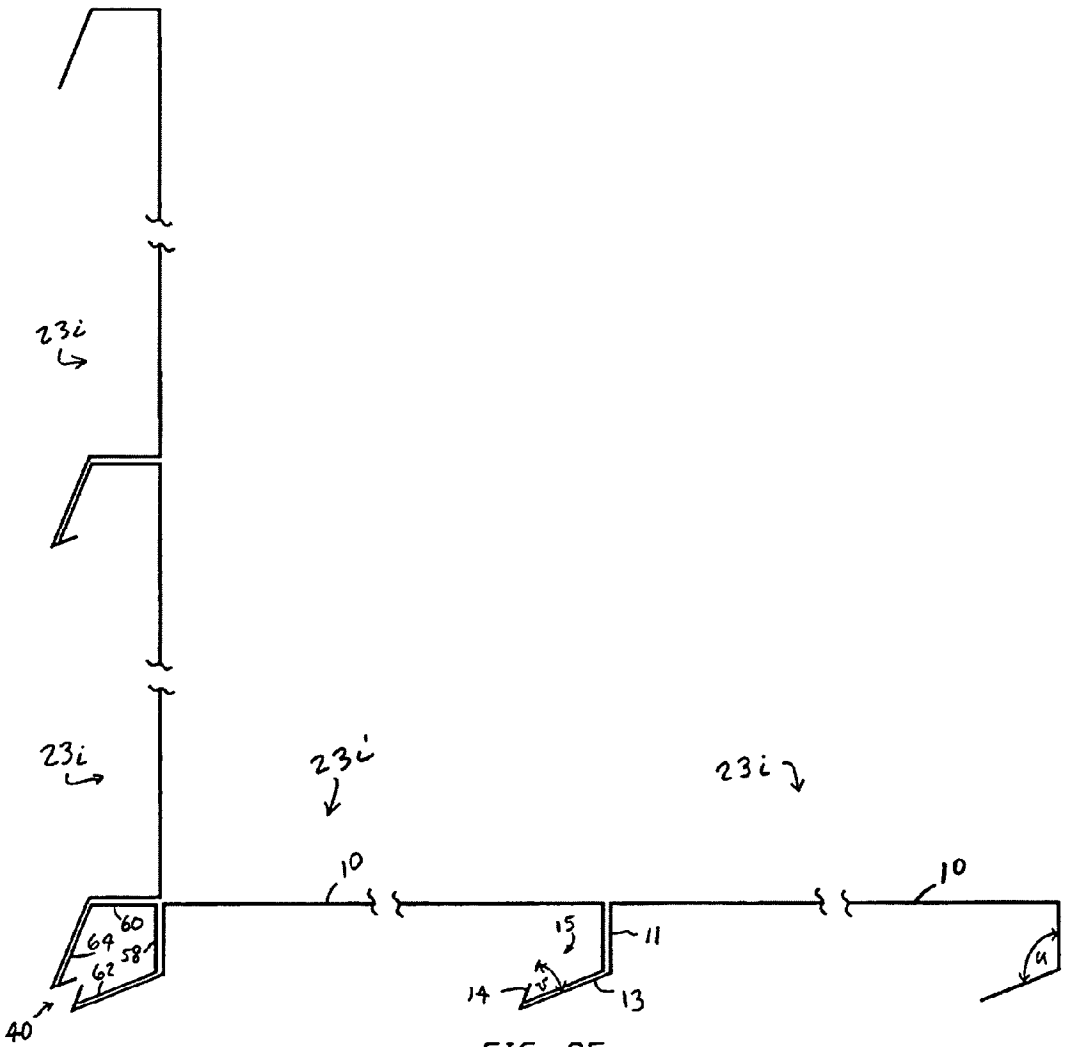
FIG. 25 is a top view of further embodiments of the present invention.

FIG. 25 show a further embodiment of panel 23 and resulting structural member. Panel 23*i* includes a relatively thin, flat, rectilinearly configured base member 10 of a predetermined area, a first rectilinear side member 11 extending from one edge thereof, and a second rectilinear side member 12 extending from an opposite edge thereof, and in the same direction with respect to the base member 10 as the first side member 11. First member 11 extends generally perpendicularly with respect to base member 10. A first lip 13 extends from the first side member 11 outwardly away from the field of the base member 10 and at an obtuse angle "u", and a second lip 14 extends from an outward edge of the first lip 13 at an acute angle "v" (preferably about 45 degrees) toward the base member 10, thereby defining a first connection channel 15. A third lip 16 extends from the second side member 12 inwardly towards the field of the base member 10 to define a second connection channel 17. The base member 10, first side member 11, second side member 12, and lips 13, 14 and 16 are preferably substantially flat and have predetermined areas and thicknesses. Panel 23*i* may be modular.

FIG. 25 also shows multiple panels 23*i* configured to form a structural member. Panels 23*i* are preferably rotated into position as described previously with respect to panels 23. Both a corner arrangement and co-linear arrangement may be accomplished with panels 23*i*.

FIG. 25 also shows a further embodiment of post 40 having post wings 62, 64 extending from generally perpendicularly disposed post walls 58, 60 at obtuse angles. Post wings 62, 64 preferably abut second lips 14 of adjacent panels 23*i* to lock the panels 23*i* into position.

In further aspects of the present invention, methods of assembly of an enclosure and spray booths are provided. One method includes the steps of providing the structures disclosed above, and rotationally engaging the post 40 within at least one of the channels 15. An adjacent side panel 23 is secured to post 40 to engage side ends of the adjacent side panels 23 to form a booth wall.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures

I claim:

1. A structural member, comprising:

a first panel including:

a base member having outer edges;

a first side member extending from one edge of the base member, the first side member having a first lip extending from an outward edge of the first side member and away from the base member, the first side member further having a second lip extending from an outward edge of the first lip and toward the base member and at an acute angle with respect to the first lip; and a second side member extending in substantially the same direction as the first side member, from an opposite edge of the base member, the second side member having a third lip extending from an outward edge of said second side member and toward the first side member;

said first panel configured to connect to at least one second panel; and having at least a second panel connected to said first panel and further comprising a corner post connectable to at least one of said first panel and said at least second panel, said post comprising at least two post walls oriented generally perpendicularly to each other, each post wall including a post wing extending from the post walls, and said post wings extending toward each other.

2. The structural member of claim 1 where the post wings are positioned generally perpendicular to each other.

3. A structural member, comprising:

a first panel including:

a base member having outer edges;

a first side member extending from one edge of the base member, the first side member having a first lip extending from an outward edge of the first side member and away from the base member, the first side member further having a second lip extending from an outward edge of the first lip and toward the base member and at an acute angle with respect to the first lip; and a second side member extending in substantially the same direction as the first side member, from an opposite edge of the base member, the second side member having a third lip extending from an outward edge of said second side member and toward the first side member;

said first panel configured to connect to at least one second panel; and a corner post coupling two panels, the post comprising at least two post walls oriented substantially perpendicularly to each other, each post wall including a post wing extending substantially perpendicularly from the post wall and said post wings extending toward each other;

and a post hook wall extending from said at least one of the post wings, and said post hook extending at an angle between about zero and 90 degrees with respect to the at least one post wing.

4. A structural member, comprising:

a first panel including:

a base member having outer edges;

a first side member extending from one edge of the base member, the first side member having a first lip extending from an outward edge of the first side member and away from the base member, the first side member further having a second lip extending from an outward edge of the first lip and toward the base member and at an acute angle with respect to the first lip; and a second side member extending in substantially the same direction as the first side member, from an opposite edge of the base member, the second side member having a third lip extending from an outward edge of said second side member and toward the first side member;

said first panel configured to connect to at least one second panel; and a post having a first post wing and a second post wing, where said post wings extend toward each other.

5. A structural member comprising:

a first panel including:

a base member having outer edges;

a first side member extending generally perpendicularly from one edge of the base member, the first side member having a first lip extending from an outward edge of the first side member and away from the base member, the first side member further having a second lip extending from an outward edge of the first lip and toward the base member and at an acute angle with respect to the first lip; and a second side member extending in substantially the same direction as the first side member, from an opposite edge of the base member, the second side member having a third lip extending generally perpendicularly from an outward edge of said second side member; and at least one second panel connectable to the first panel;

a post securable to said at least one second panel; and said post having a first post wing and a second post wing, and where said post wings extend toward each other.

6. A structural member in accordance with claim 5 further comprising a top panel having at least one slot where the top panel engages with at least one of the panels at the slot.

7. A structural member in accordance with claim 5 where said structural member comprises an enclosure.

8. A structural member in accordance with claim 7 where said enclosure comprises a spray booth having a ceiling.

9. A structural member, comprising:

at least two adjacent panels capable of forming adjacent sides of an enclosure; and a post having at least one post wing and said post engaging said at least two adjacent panels, said post having at least two sides that form a reference angle of between 0 and 90 degrees, where said reference angle is positioned opposite the enclosure, and where said at least one post wing extends into the reference angle.

10. The member of claim 9 where at least one of said at least two panels includes a first lip, and a second lip extending from an outward edge of said first lip at an angle of between about zero and 90 degrees with respect to said first lip.

* * * * *